US011353820B2

(12) United States Patent
Gamo

(10) Patent No.: US 11,353,820 B2
(45) Date of Patent: Jun. 7, 2022

(54) DEVELOPER CONTAINER STORAGE APPARATUS

(71) Applicant: CANON KABUSHIKI KAISHA, Tokyo (JP)

(72) Inventor: Yohei Gamo, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/093,883

(22) Filed: Nov. 10, 2020

(65) Prior Publication Data

US 2021/0055686 A1 Feb. 25, 2021

Related U.S. Application Data

(63) Continuation of application No. 16/812,444, filed on Mar. 9, 2020, now Pat. No. 10,859,966.

(30) Foreign Application Priority Data

Mar. 26, 2019 (JP) ..... JP2019-058811

(51) Int. Cl.
*G03G 21/16* (2006.01)

(52) U.S. Cl.
CPC ..... *G03G 21/1633* (2013.01); *G03G 21/1676* (2013.01)

(58) Field of Classification Search
CPC ..... G03G 21/1633; G03G 21/1676; G03G 15/0865; G03G 2221/169
See application file for complete search history.

(56) References Cited

U.S. PATENT DOCUMENTS

| | | | | |
|---|---|---|---|---|
| 8,396,379 | B2 | 3/2013 | Tsukijima | |
| 10,859,966 | B2 * | 12/2020 | Gamo | G03G 21/1676 |
| 2017/0315499 | A1 | 11/2017 | Maeda | |
| 2018/0113414 | A1 | 4/2018 | Ando | |

FOREIGN PATENT DOCUMENTS

| | | | |
|---|---|---|---|
| JP | 2010-256557 | A | 11/2010 |
| JP | 2017-053971 | A | 3/2017 |
| JP | 2019-109327 | A | 7/2019 |
| JP | 2019-109328 | A | 7/2019 |

* cited by examiner

*Primary Examiner* — Sandra Brase
(74) *Attorney, Agent, or Firm* — Venable LLP

(57) ABSTRACT

An image forming apparatus includes an image bearing member on which an electrostatic image is formed, a developing unit to develop the electrostatic image, a driving unit, a driving gear to drive the driving unit, and a toner replenishing container to attach to an attaching portion of the image forming apparatus and to accommodate the toner to replenish to the developing unit. In addition, a door opens and closes the attaching portion, a first mechanism changes an open/close state of the door, and a second mechanism changes an input state of the driving force to a shaft of the first mechanism.

3 Claims, 14 Drawing Sheets

DEVELOPER CONTAINER STORAGE APPARATUS

This application is a continuation of application Ser. No. 16/812,444, filed Mar. 9, 2020.

BACKGROUND OF THE INVENTION

Field of the Invention

The present invention relates to a developer container storage apparatus.

Description of the Related Art

Hitherto, an electro-photographic image forming apparatus is widely applied as a copier, a printer, a facsimile machine, a multi-function printer having a plurality of those functions and others. These image forming apparatuses use fine powdery toner as part of components of developer used in forming an image. A mechanism for removably mounting a developer container filled with the toner (referred to as a "toner container" hereinafter) to an apparatus body is widely spread in the image forming apparatuses using such toner.

Then, it is necessary to prevent a user from erroneously exchanging the toner container which has not yet reached an exchange period for the image forming apparatus having the mechanism that enables the user to exchange the toner container. Because the toner containers having a similar shape are arrayed in the image forming apparatus having a plurality of toner containers within one apparatus body in particular, the user is apt to erroneously recognize a toner container to be exchanged. Due to that, it is desirable to clearly indicate a toner container to be exchanged for the user.

Japanese Patent Application Laid-open No. 2010-256557 discloses an image forming apparatus that prevents a user from erroneously exchanging a toner container which needs not to be exchanged. This image forming apparatus is provided with an exchange door per each storage portion, is arranged such that a close state of each exchange door can be locked and includes a dedicated actuator serving as a driving unit for unlocking the close state per each exchange door. Then, the exchange door corresponding to the toner container having less toner residual quantity and to be exchanged is opened automatically by individually controlling each dedicated actuator.

However, because the image forming apparatus disclosed in Japanese Patent Application Laid-open No. 2010-256557 includes the dedicated actuator serving as the driving unit for unlocking the closed state per each exchange door, the mechanism of the image forming apparatus is complicated and requires a large number of expensive components. Due to that, it is required to simplify the mechanism and to cut the costs. In particular, the mechanism of preventing the toner container from being erroneously exchanged is often applied not to an expensive apparatus operated by an expert operator operating the image forming apparatus but to an inexpensive image forming apparatus for which an average user exchanges the toner container by himself. From this fact, it is required to simplify the mechanism and to cut the costs.

Accordingly, an object of the present disclosure is to be able to unlock a close state of an exchange door of a storage portion storing a developer container with a simple mechanism.

SUMMARY OF THE INVENTION

According to a first aspect of the present invention, a developer container storage apparatus includes a storage portion configured to store a developer container, a door configured to open and close the storage portion, a locking member configured to be switched between a first position in which the locking member locks the door in a close state and a second position in which the locking member is unable to lock the door in the close state, a lock urging portion configured to urge the locking member toward the first position, a driving source, a rotation shaft configured to rotate by a driving force from the driving source, a cylindrical sleeve slidably provided around an outer circumference of the rotation shaft, and an engage portion provided on an outer circumferential portion of the sleeve and configured to engage with the locking member and switch the locking member from the first position to the second position. The rotation shaft is relatively movable in a rotation axial direction with respect to the sleeve between an engage position where the rotation shaft and the sleeve rotate in a body by engaging with each other and a disengage position where the rotation shaft and the sleeve idle without being engaged. In a case where the door is in the close state, the rotation shaft is located at the engage position, and if the rotation shaft rotates, the engage portion switches the locking member from the first position to the second position so that the door is made unlockable in the close state. In a case where the door is in an open state, the rotation shaft is located at the disengage position, and the lock urging portion switches the locking member from the second position to the first position so that the door is made lockable in the close state.

According to a second aspect of the present invention, a developer container storage apparatus includes a storage portion configured to store a developer container, a door configured to open and close the storage portion, a locking member configured to be switched between a first position in which the locking member locks the door in a close state and a second position in which the locking member is unable to lock the door in the close state, a lock urging portion configured to urge the locking member toward the first position, a driving source, a rotation shaft configured to rotate by a driving force from the driving source and move along a rotation axial direction, and an engage portion provided on an outer circumferential portion of the rotation shaft and configured to switch between an engage position where the engage portion is engagable with the locking member and a disengage position where the rotation shaft idles without engaging with the locking member by moving of the rotation shaft in the rotation axial direction. In a case where the door is in the close state, the engage portion is located at the engage position, and if the rotation shaft rotates, the engage portion switches the locking member from the first position to the second position so that the door is made unlockable in the close state. In a case where the door is in an open state, the engage portion is located at the disengage position, and the lock urging portion switches the locking member from the second position to the first position so that the door is made lockable in the close state.

Further features of the present invention will become apparent from the following description of exemplary embodiments with reference to the attached drawings.

DESCRIPTION OF THE EMBODIMENTS

First Embodiment

Whole of Image Forming Apparatus

A first embodiment of the present disclosure will be described below in detail with reference to FIGS. 1 through 12. Note that the present embodiment describes about a tandem type full-color printer as one example of an image forming apparatus. However, the present disclosure is not limited to be the tandem type image forming apparatus and may be another type image forming apparatus. Still further, the present disclosure is not limited to be a full-color image forming apparatus and may be a monochrome or mono-color image forming apparatus.

Figure 1:
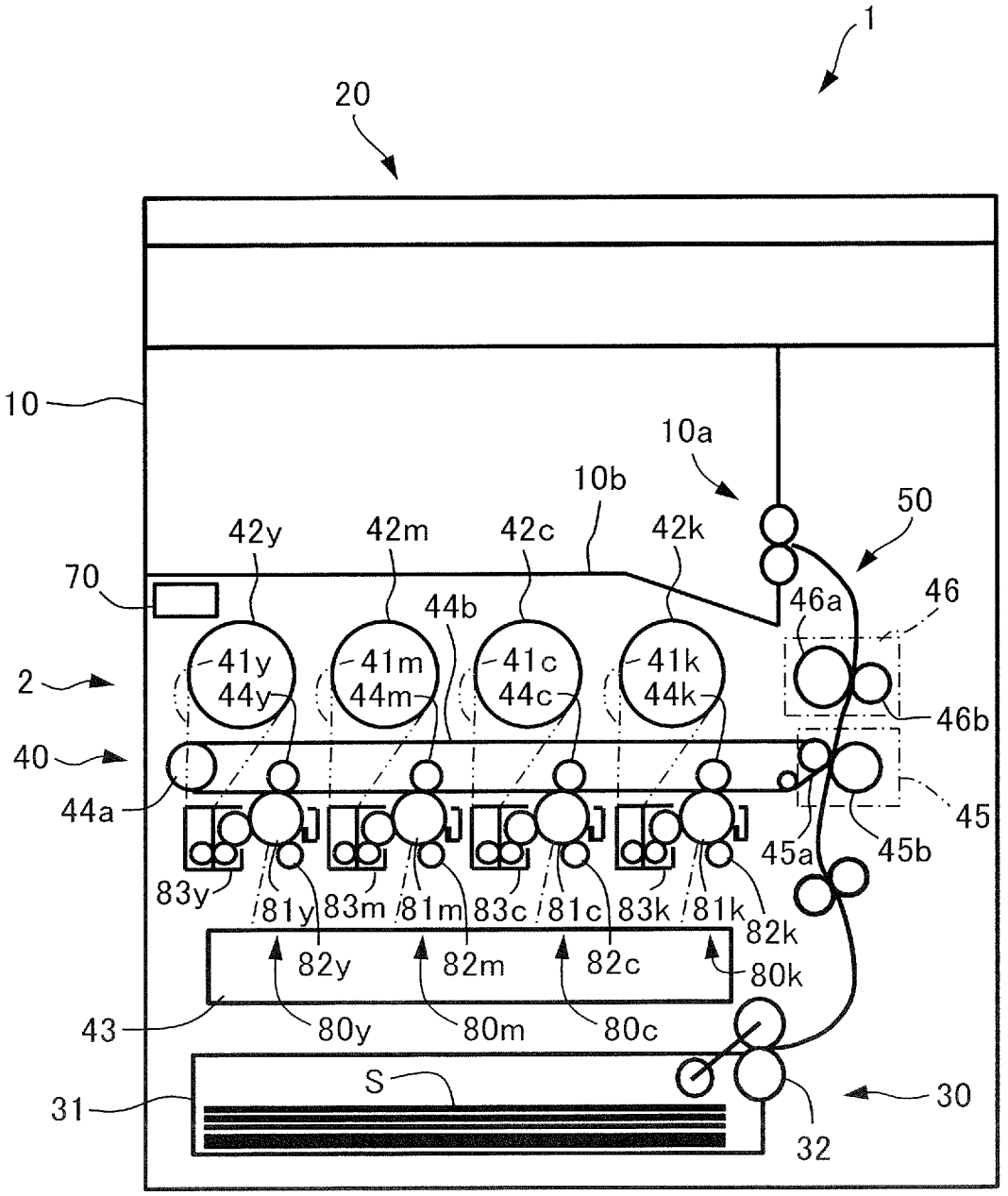
FIG. 1 is a section view schematically illustrating a structure of an image forming apparatus of a first embodiment.

As illustrated in FIG. 1, the image forming apparatus 1 includes an apparatus body 10. The apparatus body 10 includes an image reading unit 20, a sheet feeding unit 30, an image forming unit 40, a sheet conveyance unit 50 and a control portion 70. Note that a sheet S is a recording material on which a toner image is to be formed and may be a plain sheet of paper, a plastic sheet which is a substitute of the sheet of paper, a thick sheet, an overhead projector sheet and the like. Note that a front side facing the image forming apparatus 1 will be denoted as a front side F and a rear side as a back side B in the present embodiment as indicated in each drawing.

The image reading unit 20 is provided at an upper part of the apparatus body 10 and reads an image of a document or the like to convert into image information which is an electrical signal. The sheet feeding unit 30 is disposed at a lower part of the apparatus body 10, includes a sheet cassette 31 for loading and storing the sheet S and a feed roller 32 to feed the sheet S stored in the cassette 31 to the image forming unit 40.

The image forming unit 40 includes image forming units 80*y*, 80*m*, 80*c* and 80*k*, a toner replenishing unit 2, a laser scanner 43, an intermediate transfer unit 44, a secondary transfer portion 45 and a fixing unit 46. The image forming unit 40 is capable of forming an image on the sheet S based on the image information. The toner replenishing unit 2 includes toner hoppers 41*y*, 41*m*, 41*c* and 41*k*, toner containers, i.e., developer containers, 42*y*, 42*m*, 42*c* and 42*k* and a developer container storage apparatus 3 (see FIGS. 4A and 4B). Note that the image forming apparatus 1 of the present embodiment corresponds to a full-color image forming apparatus, and the image forming units 80*y*, 80*m*, 80*c* and 80*k* are separately provided with similar configurations for each of four colors of yellow (y), magenta (m), cyan (c) and black (k). The toner hoppers 41*y*, 41*m*, 41*c* and 41*k* and the toner containers 42*y*, 42*m*, 42*c* and 42*k* are also provided separately with similar configurations for each of the four colors of yellow (y), magenta (m), cyan (c) and black (k). Due to that, the yellow image forming unit 80*y* will be typically described below.

The toner container 42*y* capable of storing developer is disposed above the image forming unit 80*y* through the toner hopper 41*y*. The toner container 42*y* is removably mounted corresponding to the hole-shaped mount portion 12*y* serving as the storage portion provided in the apparatus body 10 (see FIG. 2). That is, the mount portion 12*y* can store the toner container 42*y*. The toner container 42*y* is a cylindrical bottle having a toner discharge port at one end thereof for example and has a spiral projecting portion on an inner circumferential surface to convey toner to the toner discharge port by rotating the toner container 42*y*. The toner container 42*y* is connected with a driving motor 52 (see FIG. 3) such that the toner container 42*y* is rotated by the driving motor 52 to discharge the toner. Note that the developer container storage apparatus 3 of the toner replenishing unit 2 will be detailed later.

Figure 2:
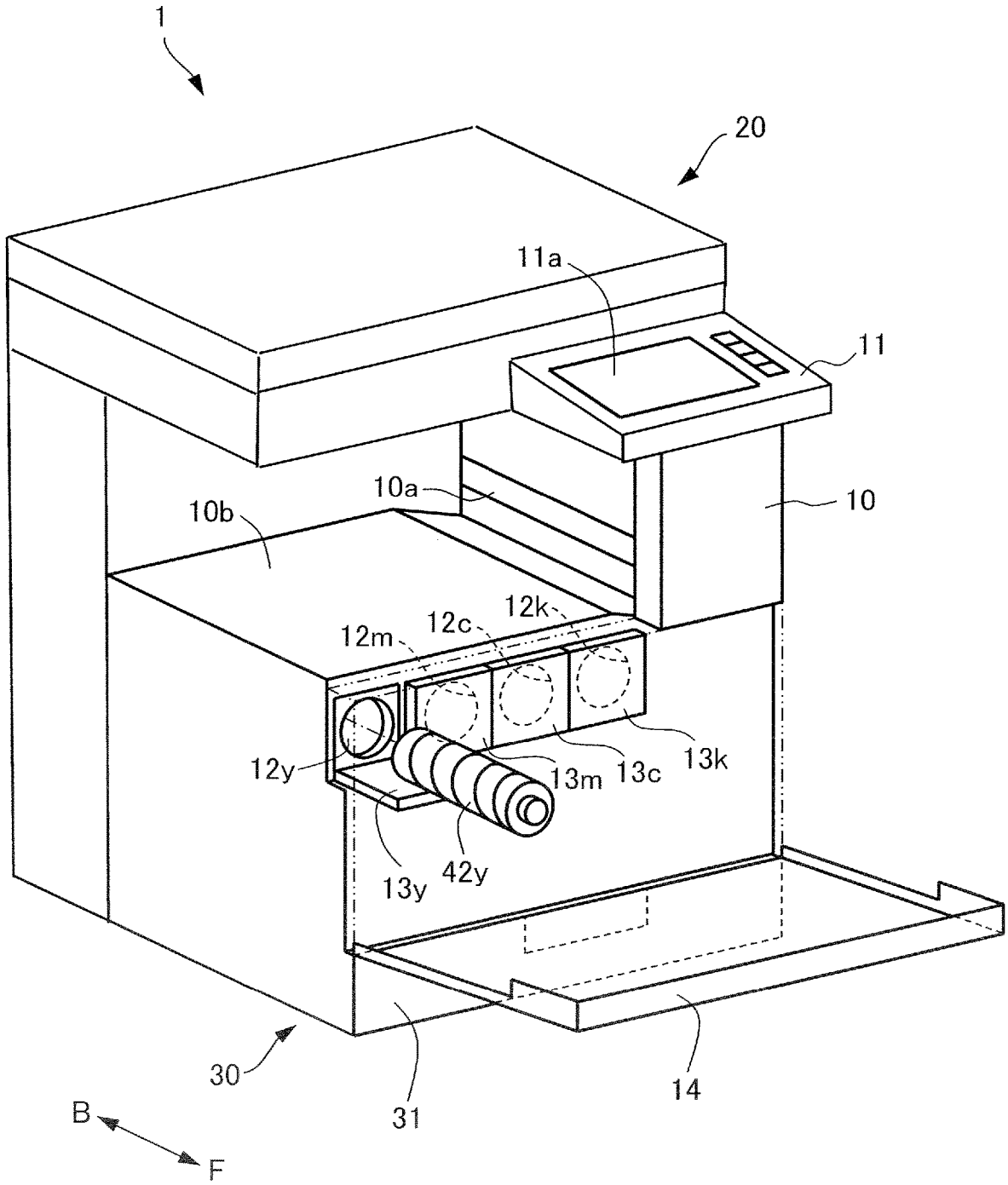
FIG. 2 is a perspective view schematically illustrating the structure of the image forming apparatus of the first embodiment.

As illustrated in FIG. 2, exchange doors 13*y*, 13*m*, 13*c* and 13*k* serving as doors or exchange doors of the developer replenishing containers are openably provided at a front part of the apparatus body 10. For instance, the toner container 42*y* can be mounted to/drawn out from the apparatus body 10 from a front surface when the exchange door 13*y* is opened. In the same manner, when the exchange doors 13*m*, 13*c* and 13*k* are opened respectively, the toner containers 42*m*, 42*c* and 42*k* can be mounted to/drawn out from the apparatus body 10 from the front surface. That is, the exchange door 13*y* is openable to be an open state in which the toner container 42*y* can be mounted to/drawn out of the mount portion 12*y* and to be a closed state in which the toner container 42*y* cannot be mounted to/drawn out of the mount portion 12*y*. The mount portions 12*y*, 12*m*, 12*c* and 12*k* and the exchange doors 13*y*, 13*m*, 13*c* and 13*k* are also separately provided in the similar configurations respectively for each of the four colors of yellow (y), magenta (m), cyan (c)

and black (k). Due to that, the yellow mount portion 12*y* and the yellow exchange door 13*y* will be typically described below. Note that a detailed configuration of the exchange door 13*y* will be described later.

A front door 14 which is openable by swinging forward is provided at a front part of the apparatus body 10. The front door 14 is openable into the open state in which the exchange door 13*y* is openably exposed and the toner container 42*y* can be mounted to/drawn out of the mount portion 12*y* and into the close state in which the exchange door 13*y* is shaded and the toner container 42*y* cannot be mounted to/drawn out of the mount portion 12*y*.

An operating portion 11 is provided at a front upper part of the apparatus body 10. An operating panel 11*a* being capable of displaying states of the image forming apparatus 1 and being composed of a touch panel that enables to control the apparatus through touch operations are provided, beside operating buttons. The operating panel 11*a* is connected with a control portion 70 (see FIG. 3) such that displayed contents are controlled by the control portion 70 and information can be inputted from outside.

As illustrated in FIG. 1, the image forming unit 80*y* includes a photosensitive drum 81*y* configured to form a toner image, a charging roller 82*y*, a developing unit 83*y* and a cleaning blade. In the present embodiment, the image forming unit 80*y* is attachable to/detachable from the apparatus body 10. The photosensitive drums 81*y*, 81*m*, 81*c* and 81*k*, the developing units 83*y*, 83*m*, 83*c* and 83*k* and a developing sleeve described later are also provided separately with similar configurations respectively for each of the four colors of yellow (y), magenta (m), cyan (c) and black (k).

The photosensitive drum 81*y* is rotated by a drum motor not illustrated such that the photosensitive drum 81*y* moves circularly while bearing an electrostatic image formed based on image information in forming an image. The charging roller 82*y* is in contact with a surface of the photosensitive drum 81*y* to charge the surface. The developing unit 83*y* includes the developing sleeve rotatably provided in the developing container to develop the electrostatic latent image formed on the photosensitive drum 81*y* by the toner. Two-component developer which is a mixture of nonmagnetic toner and magnetic carrier is stored in the developing unit 83*y*, and the toner is supplied from the toner container 42*y* filled with the toner through the toner hopper 41*y*.

Figure 3:
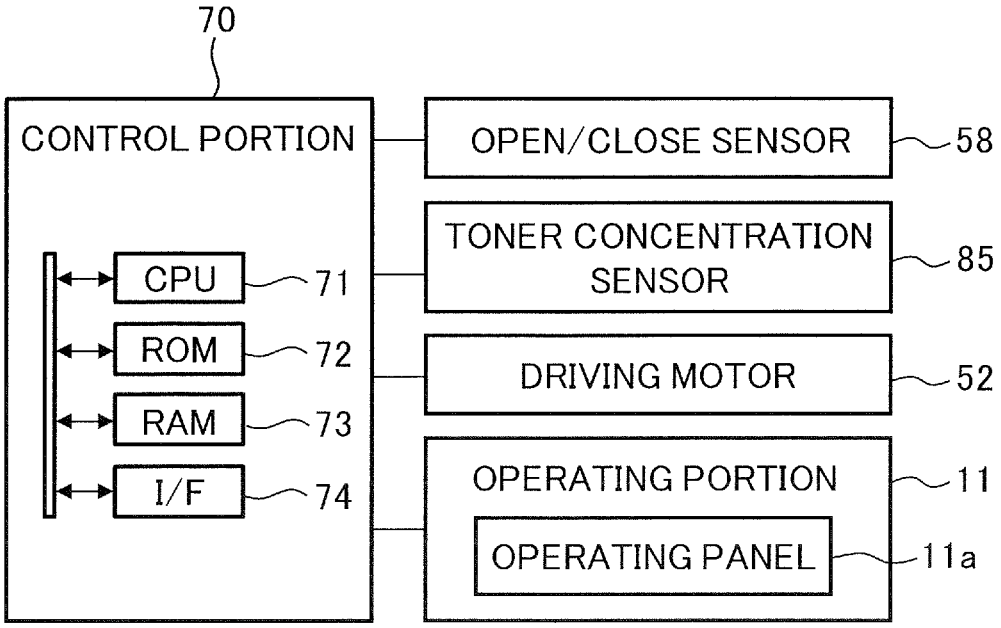
FIG. 3 is a block diagram illustrating a control system of the image forming apparatus of the first embodiment.

The developing unit 83*y* is provided with a toner concentration sensor 85 (see FIG. 3). The toner concentration sensor 85 is composed of an inductance sensor for example, is capable of detecting toner concentration within the developing unit 83*y* and transmits a detection result to the control portion 70. In a case where the toner concentration detected by the toner concentration sensor 85 is lower than target toner concentration, the control portion 70 drives the driving motor 52 (see FIG. 3) to replenish toner from the toner container 42*y* to the developing unit 83*y*.

The cleaning blade is disposed in contact with the surface of the photosensitive drum 81*y* to clean the developer left on the surface of the photosensitive drum 81*y* after primary transfer. The laser scanner 43 exposes the surface of the photosensitive drum 81*y* charged by the charging roller 82*y* to form the electrostatic latent image on the surface of the photosensitive drum 81*y*.

The intermediate transfer unit 44 includes a plurality of rollers such as a driving roller 44*a*, driven rollers not illustrated and primary transfer rollers 44*y*, 44*m*, 44*c* and 44*k* and an intermediate transfer belt 44*b* wound around these rollers. The toner image having negative polarity on the photosensitive drum 81*y* is transferred onto the intermediate transfer belt 44*b* by applying positive polarity transfer bias to the intermediate transfer belt 44*b* by the primary transfer roller 44*y*. The secondary transfer portion 45 includes a secondary transfer inner roller 45*a* and a secondary transfer outer roller 45*b*. A full-color image formed on the intermediate transfer belt 44*b* is transferred onto the sheet S by applying positive polarity secondary transfer bias to the secondary transfer outer roller 45*b*.

The fixing unit 46 includes a fixing roller 46*a* and a pressure roller 46*b*. The toner image transferred onto the sheet S is fixed to the sheet S by being heated and pressurized by being nipped and conveyed between the fixing roller 46*a* and the pressure roller 46*b*. A sheet conveyance unit 50 conveys the sheet S fed from the sheet feeding unit 30 through the image forming unit 40 and the discharge port 10*a* to stack on a discharge tray 10*b*.

As illustrated in FIG. 3, the control portion 70 is composed of a computer and includes a CPU 71, a ROM 72 storing programs for controlling respective portions, a RAM 73 temporarily storing data and an input/output circuit (I/F) 74. The control portion 70 is connected with the image forming unit 40, the sheet conveyance unit 50, the operating portion 11, an opening/closing sensor 58 described later, the toner concentration sensor 85, the driving motor 52 and others through the input/output circuit 74 to exchange signals with and to control the respective portions. The control portion 70 also enables the user to operate or to set through commands from a computer not illustrated and connected with the apparatus body 10 or through operations made through the operating portion 11.

Next, an image forming operation of the image forming apparatus 1 constructed as described above will be described. When the image forming operation is started, the photosensitive drum 81*y* rotates and the surface thereof is charged by the charging roller 82*y* as illustrated in FIG. 1. Then, the laser scanner 43 irradiates the photosensitive drum 81*y* with a laser beam based on the image information to form the electrostatic latent image on the surface of the photosensitive drum 81*y*. The electrostatic latent image is developed by toner to visualize as a toner image which is then transferred onto the intermediate transfer belt 44*b*.

Meanwhile, in parallel with such toner image forming operation, the feed roller 32 rotates and feeds an uppermost sheet S while separating the uppermost sheet S from other sheets in the cassette 31. Then, the sheet S is conveyed to the secondary transfer portion 45 through a conveyance path while synchronizing with the toner image on the intermediate transfer belt 44*b*. The toner image is then transferred from the intermediate transfer belt 44*b* to the sheet S. The sheet S is conveyed to the fixing unit 46 such that a non-fixed toner image undergoes heat and pressure to be fixed on the surface of the sheet S. Then, the sheet S is discharged out of the discharge port 10*a* to be stacked on the discharge tray 10*b*.

Developer Container Storage Apparatus

Figure 4A:
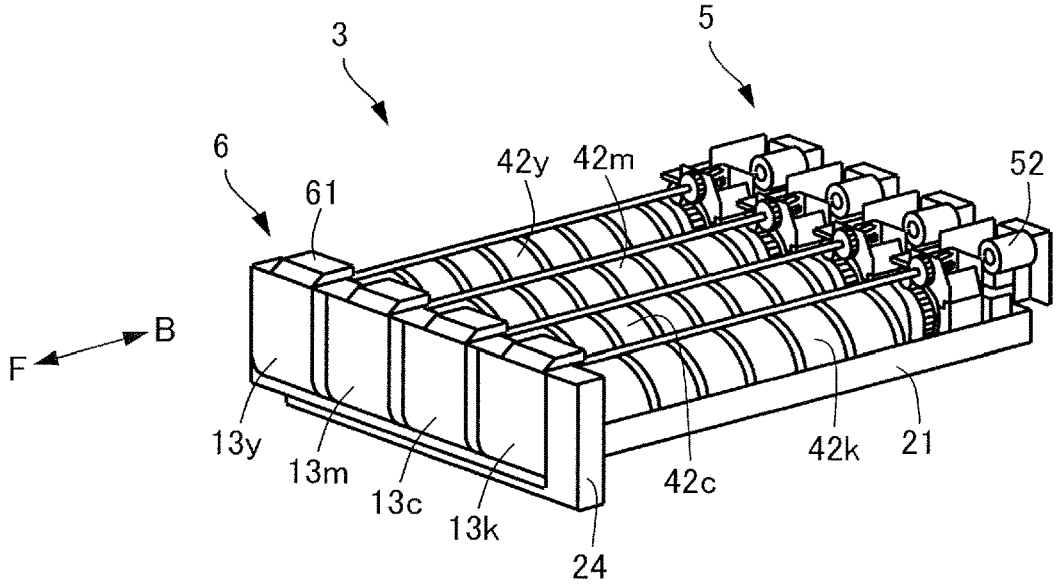
FIG. 4A is a perspective view illustrating a developer container storage apparatus of the first embodiment in a state in which exchange doors are closed after mounting all toner containers.

As illustrated in FIG. 4A, the developer container storage apparatus 3 includes a cartridge tray 21 on which the mount portions 12*y* (see FIG. 2) into which the toner containers 42*y* can be mounted are arrayed, the exchange doors 13*y*, locking units 6 and cartridge driving devices 5. According to the present embodiment, the exchange door 13*y* is disposed on the front side F (upstream side) of the mount portion 12*y* in terms in a front-back direction which is an insert direction of the toner container 42*y* and the driving motor is disposed on the back side B (downstream side) of the mount portion 12*y*. The cartridge tray 21 guides the toner container 42*y* in mounting into the mount portion 12*y*, i.e., into the image forming apparatus 1 and holds the toner container 42*y* after mounting the toner container 42*y*. The cartridge driving device 5 rotationally operates the toner container 42*y*. As the toner container 42*y* rotates, the toner within the toner container 42*y* is conveyed and replenished to the developing unit 83. The inner cover 24 is fixedly provided to the apparatus body 10 (see FIG. 1) and is provided with mount holes formed corresponding to the toner container 42 of each color.

Figure 4B:
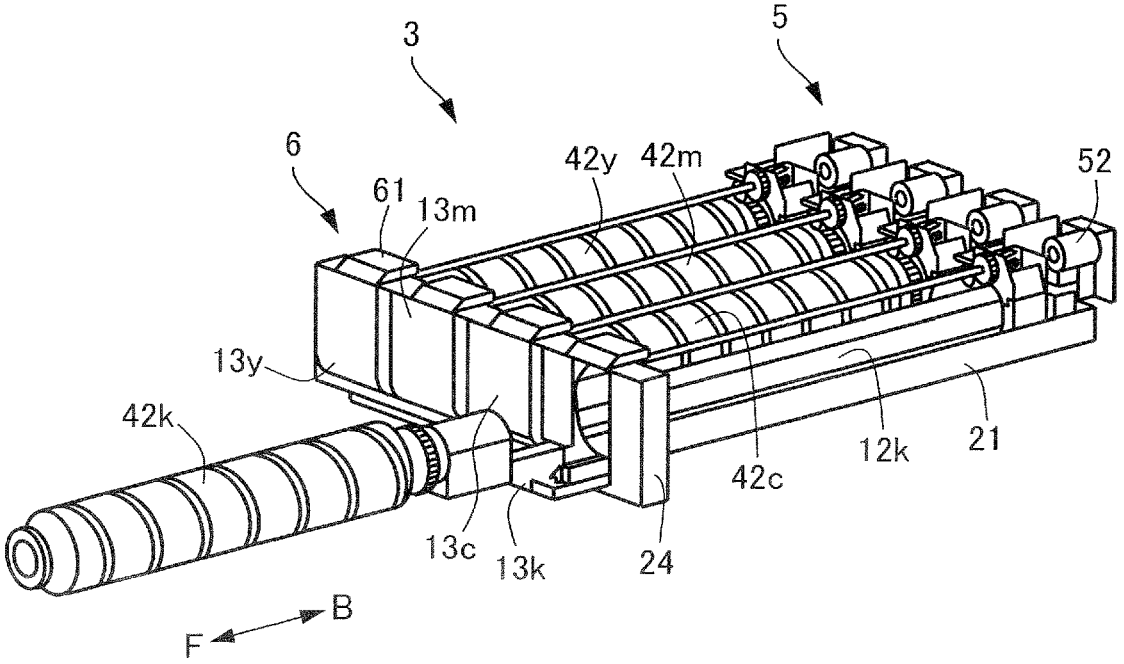
FIG. 4B is a perspective view illustrating the developer container storage apparatus of the first embodiment in a state in which a part of the exchange doors is opened to take out the toner container.

As illustrated in FIG. 4B, a toner container 42*k* is mounted to/drawn out of a mount portion 12*k* through the mount hole in the front-back direction of the front side F and the back side B. Note that while FIG. 4B illustrates a case where the black toner container 42*k* is mounted to/drawn out of the mount portion 12*k*, the other color toner containers also have the same configuration. An exchange door 13*k* is a door for opening/closing the mount portion 12*k* and the toner container 42*k* can be mounted to/drawn out of the mount portion 12*k* only when the exchange door 13*k* is opened. The locking unit 6 is a unit having a function of locking the exchange door 13*y* in the closed state and a function of releasing the lock. A driving force for releasing the lock is transmitted from the cartridge driving device 5.

The toner container 42*y* includes an opening portion not illustrated at an end portion of the back side B. The toner container 42*y* is cylindrical and includes a spiral projection on an inner wall thereof to convey the toner therein to a vicinity of the opening portion by being driven and rotated by the cartridge driving device 5. The toner conveyed to the opening portion not illustrated drops into the toner hopper 41*y* (see FIG. 1) by its own weight to be supplied to the developing unit 83. A cartridge gear 42*a* (see FIG. 5) for rotating the toner container 42*y* by the cartridge driving device 5 is provided at part of the toner container 42*y* on the back side B.

Figure 5:
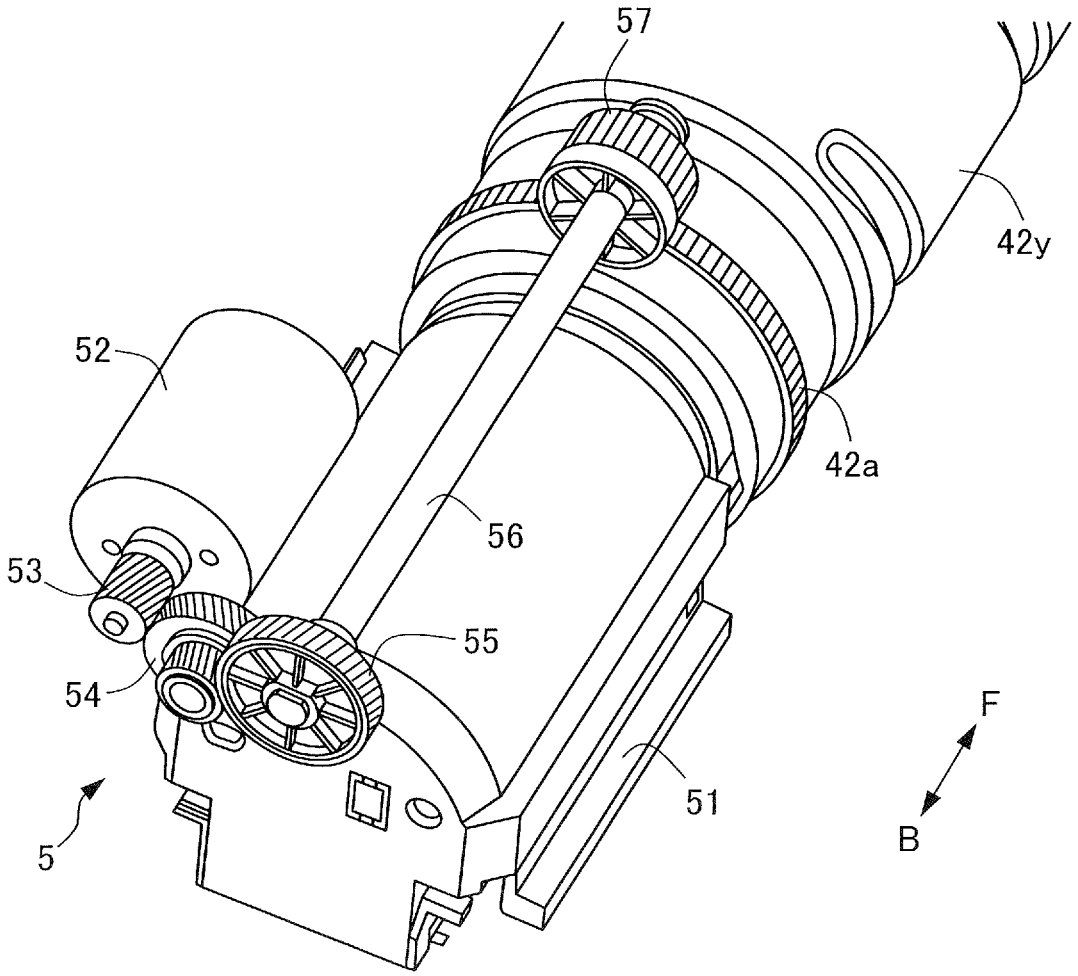
FIG. 5 is a perspective view illustrating a cartridge driving device of the first embodiment.
Figure 6:
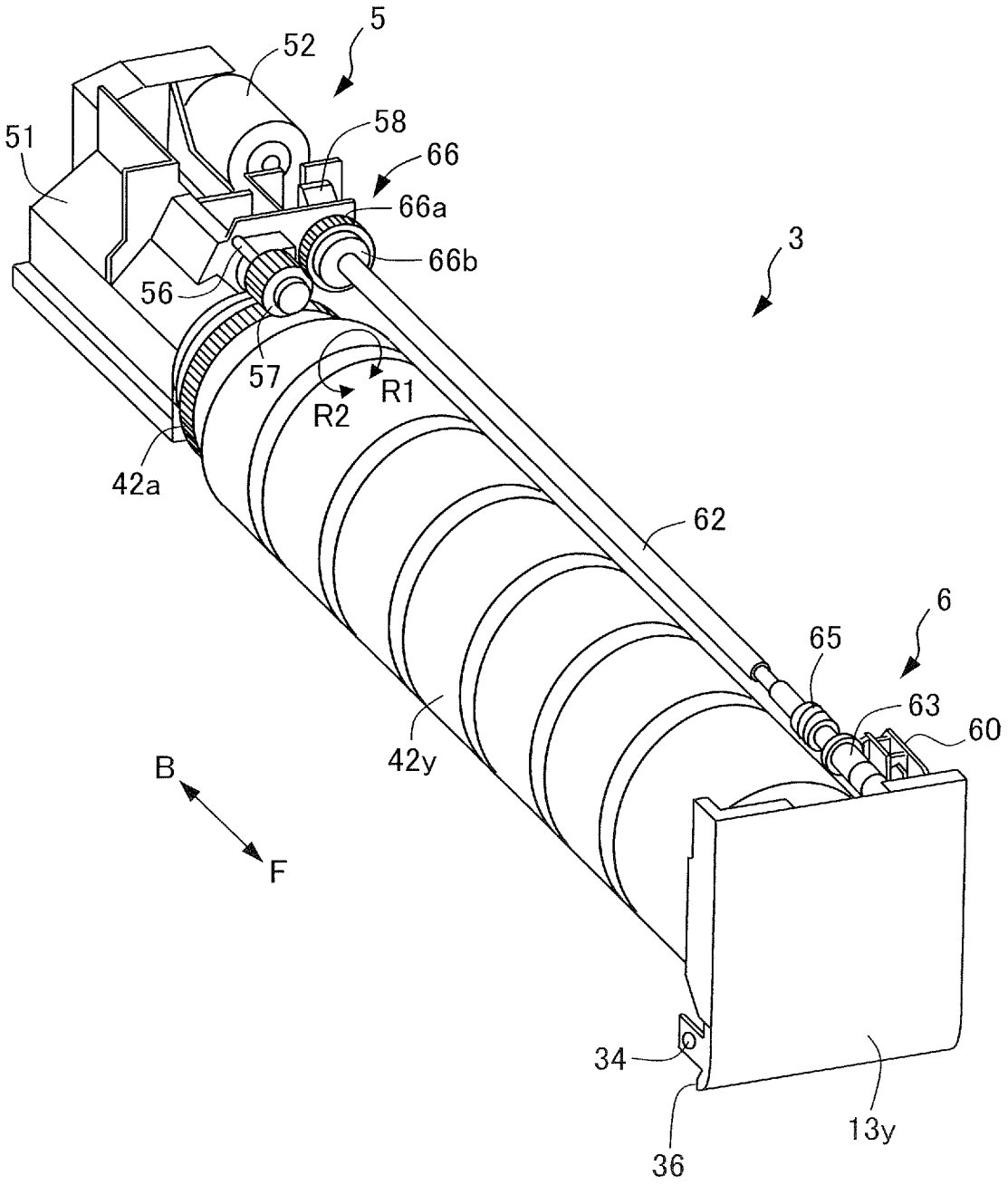
FIG. 6 is a perspective view illustrating the developer container storage apparatus of the first embodiment.

As illustrated in FIGS. 5 and 6, the cartridge driving device 5 includes a base 51, a driving motor 52 serving as a driving source, a pinion gear 53, a speed reduction gear 54, a transmission gear 55, a transmission shaft 56, a driving gear 57, an opening/closing sensor 58 and others. The driving motor 52 is fixed to the base 51, and the pinion gear 53 is press-fitted to a rotation shaft of the driving motor 52. The speed reduction gear 54 is rotatably held by the base 51 and is disposed with a positional relationship of engaging with the pinion gear 53 and the transmission gear 55. Thereby, a driving force is transmitted from the pinion gear 53 to the transmission gear 55. The transmission shaft 56 is rotatably held by the base 51, the transmission gear 55 is fixed at one end of the transmission shaft 56 and the driving gear 57 is fixed at another end of the transmission shaft 56. That is, the transmission shaft 56 links the transmission gear 55 with the driving gear 57 and is disposed in the front-rear direction. Still further, the driving gear 57 is disposed upstream, i.e., at the front side F, as compared to the transmission gear 55 and the driving motor 52 in terms of the front-back direction.

The opening/closing sensor 58 is an optical sensor having a light-emitting portion and a light-receiving portion configured to receive a beam from the light-emitting portion and is capable of detecting whether a shaft 62 described later shades the beam between the light-emitting portion and the light-receiving portion (see FIGS. 8A through 8C). The opening/closing sensor 58 detects the open/close state of the exchange door 13*y* by detecting an axial position of the shaft 62. Its detail will be described in a description of the locking unit 6 described later.

The rotational drive of the driving motor 52 is transmitted to the driving gear 57 through the pinion gear 53, the speed reduction gear 54, the transmission gear 55 and the transmission shaft 56. In a case where the toner container 42*y* is mounted to the mount portion 12*y*, a cartridge gear 42*a* provided on the toner container 42*y* is disposed with a positional relationship of engaging with the driving gear 57, and the toner container 42*y* rotates as the driving gear 57 rotates. Note that as for a rotation direction of the driving gear 57, the toner is supplied from the toner container 42*y* to the developing unit 83*y* by rotating the toner container 42*y* by rotating the driving gear 57 in a R1 direction. That is, the driving gear 57 is linked with the driving motor 52 and the developer can be delivered out of the toner container 42*y* by rotating the toner container 42*y* stored in the mount portion 12*y* in the R1 direction.

Note that it is desirable to keep away the driving motor 52 serving as the driving source from the toner container 42*y* if heat produced by the driving motor 52 is taken into account. Due to that, the driving motor 52 is often disposed on the back side B of the apparatus body 10, and the pinion gear 53, the speed reduction gear 54 and the transmission gear 55 are also disposed on the back side B of the apparatus body 10. The driving gear 57 is positioned closer to the front side F of the apparatus body 10 more than the driving motor 52, the pinion gear 53, the speed reduction gear 54 and the transmission gear 55 serving as a driving train for driving the toner container 42*y*.

Exchange Door

Figure 7:
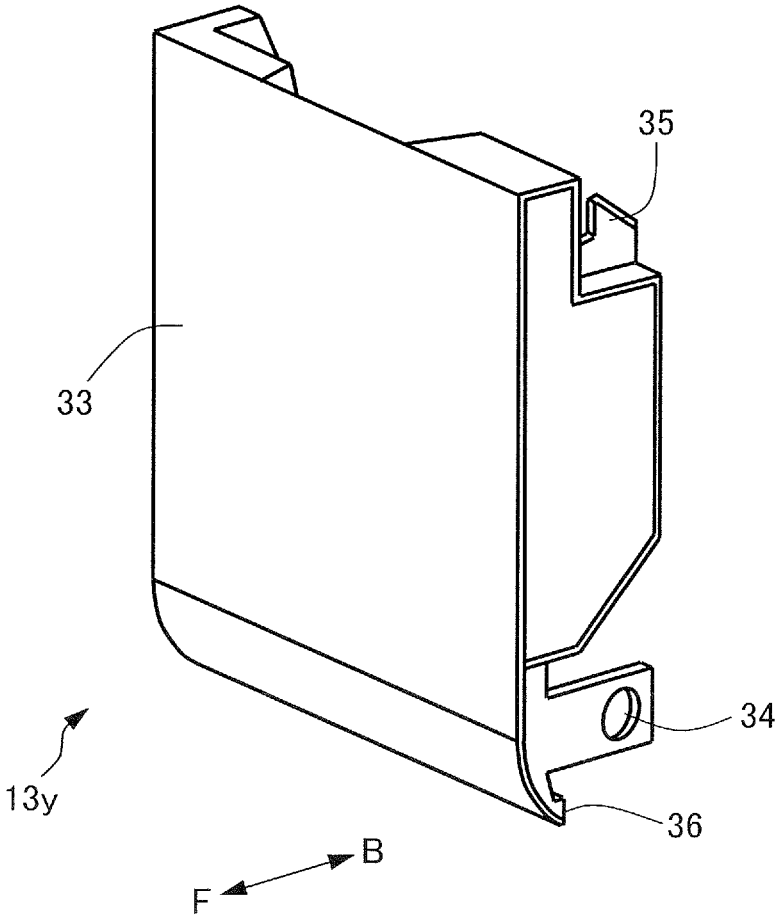
FIG. 7 is a perspective view illustrating the exchange door of the first embodiment.

Next, the exchange door 13*y* will be described with reference to FIGS. 7 through 8C. The exchange door 13*y* includes a door body 33, a center hole 34, a claw portion 35 and a rotation stopping portion 36. A pair of right and left center holes 34 is provided so as to be rotatably engaged with a rotation shaft 37 serving as a swing shaft provided in the inner cover 24. Thereby, the exchange door 13*y* is rotatably held by the inner cover 24. That is, the exchange door 13*y* can be opened/closed by swinging centering on the rotation shaft 37, disposed under a center of gravity G of the door 13*y* when the door 13*y* erects upright, in its rotation axial direction in a horizontal direction. Note that in a state in which the exchange door 13*y* erects upright (see FIG. 7), the center of gravity G of the exchange door 13*y* is located at the front side F of a center line linking the pair of center holes 34. That is, in a case where the exchange door 13*y* erects upright in a close state, the center of gravity G is located at the front side F in terms of a direction of opening the exchange door 13*y* more than the rotation shaft 37. Therefore, the exchange door 13*y* is rotatably supported by the center holes 34 and in a case where no external force acts, the exchange door 13*y* falls down to the front side F and opens by its own weight. This arrangement makes it possible to require no spring member dedicated for opening the exchange door 13*y*.

Figure 8A:
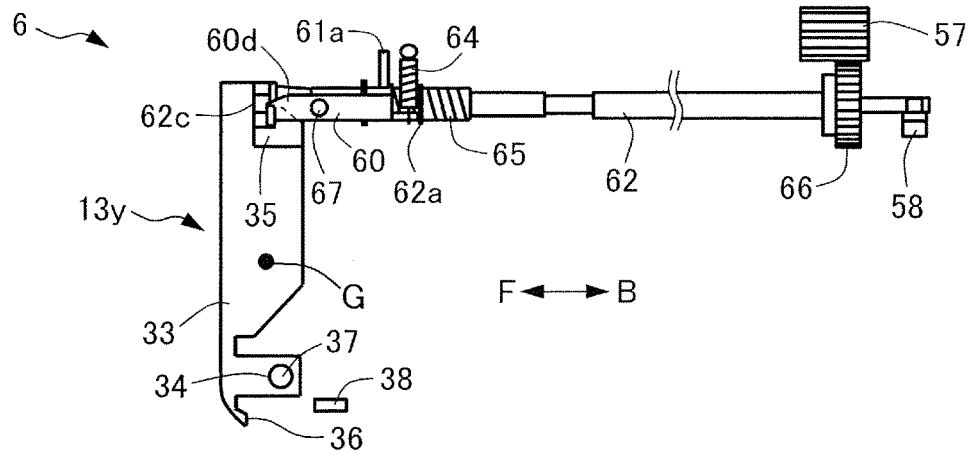
FIG. 8A is a side view illustrating a locking unit of the first embodiment in a state in which the exchange door is closed.

As illustrated in FIG. 8A, in a case where the exchange door 13*y* is closed, the claw portion 35 is engaged with a lock portion 60*d* at the front side F of a latch 60 described later, so that the exchange door 13*y* will not swing with respect to the inner cover 24 (see FIGS. 4A and 4B) and the exchange door 13*y* is held in the closed state. Note that the latch 60 is one component composing the locking unit 6 and will be described in detail in a description of the locking unit 6. As illustrated in FIG. 8B, in a case where the latch 60 is swung and the engagement of the lock portion 60*d* of the latch 60 with the claw portion 35 is released, the exchange door 13*y* becomes swingable. At this time, because the center of gravity G of the exchange door 13*y* is provided on the side of opening the exchange door 13*y*, the exchange door 13*y* swings by its own weight in the direction of opening when the engagement of the latch 60 with the claw portion 35 is released. As illustrated in FIG. 8C, the exchange door 13*y* swings to a position where the rotation stopping portion 36 butts against a stopper 38 provided on the inner cover 24, and the position of the exchange door 13*y* is defined by the butting. This state is a state in which the exchange door 13*y* is completely opened.

Locking Unit

Figure 9:
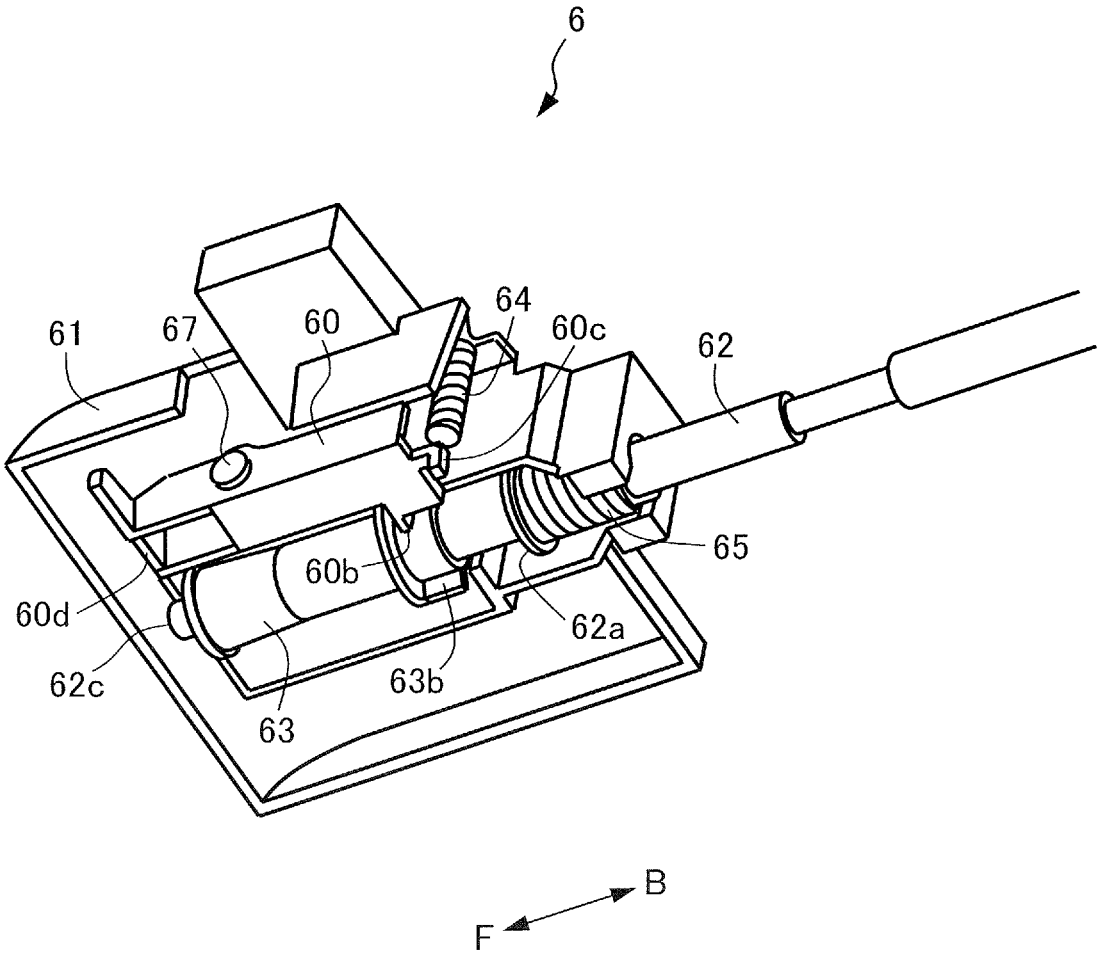
FIG. 9 is a perspective view illustrating the locking unit of the first embodiment.
Figure 10:
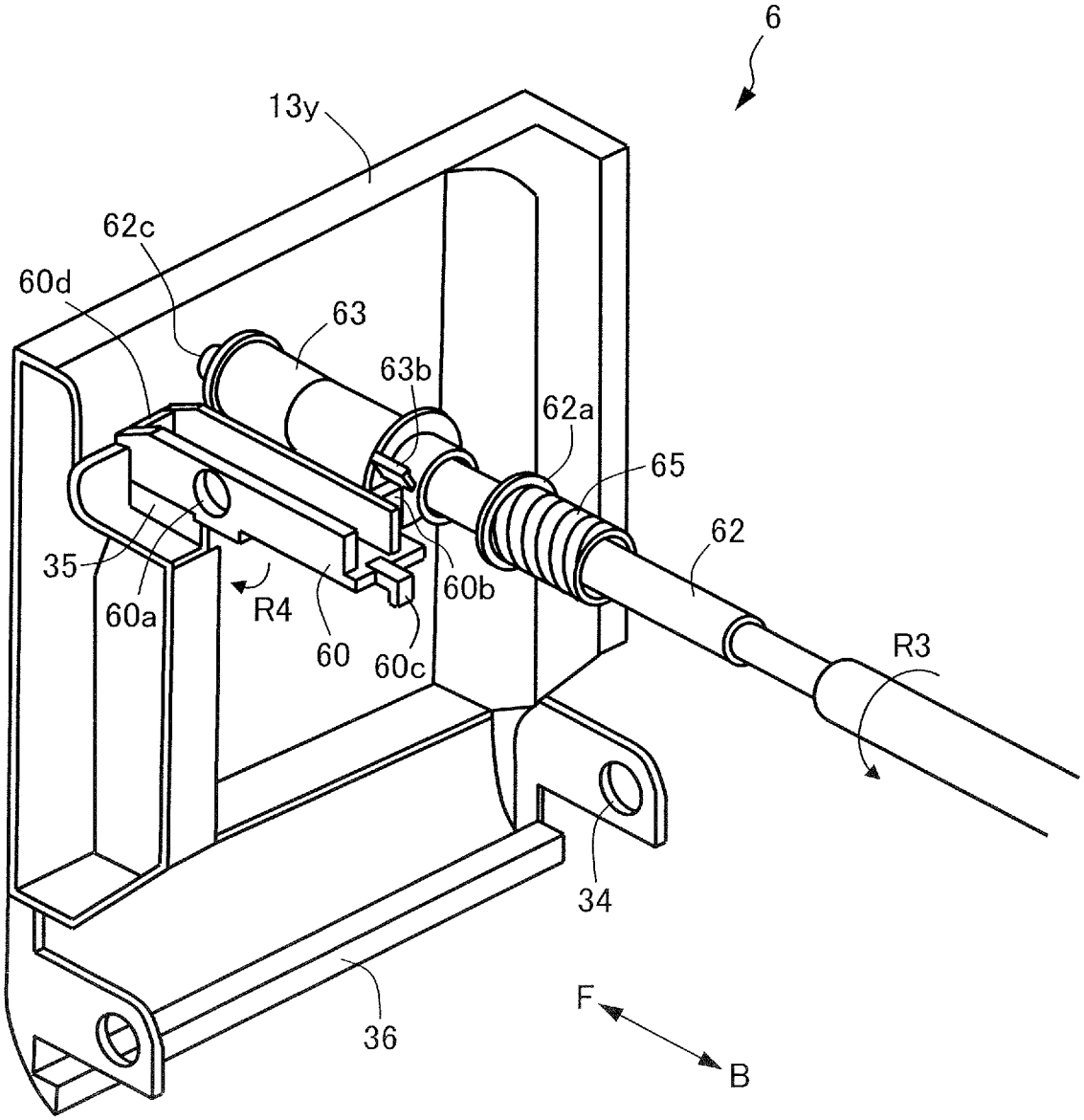
FIG. 10 is a perspective view illustrating the locking unit and the exchange door of the first embodiment.
Figure 11:
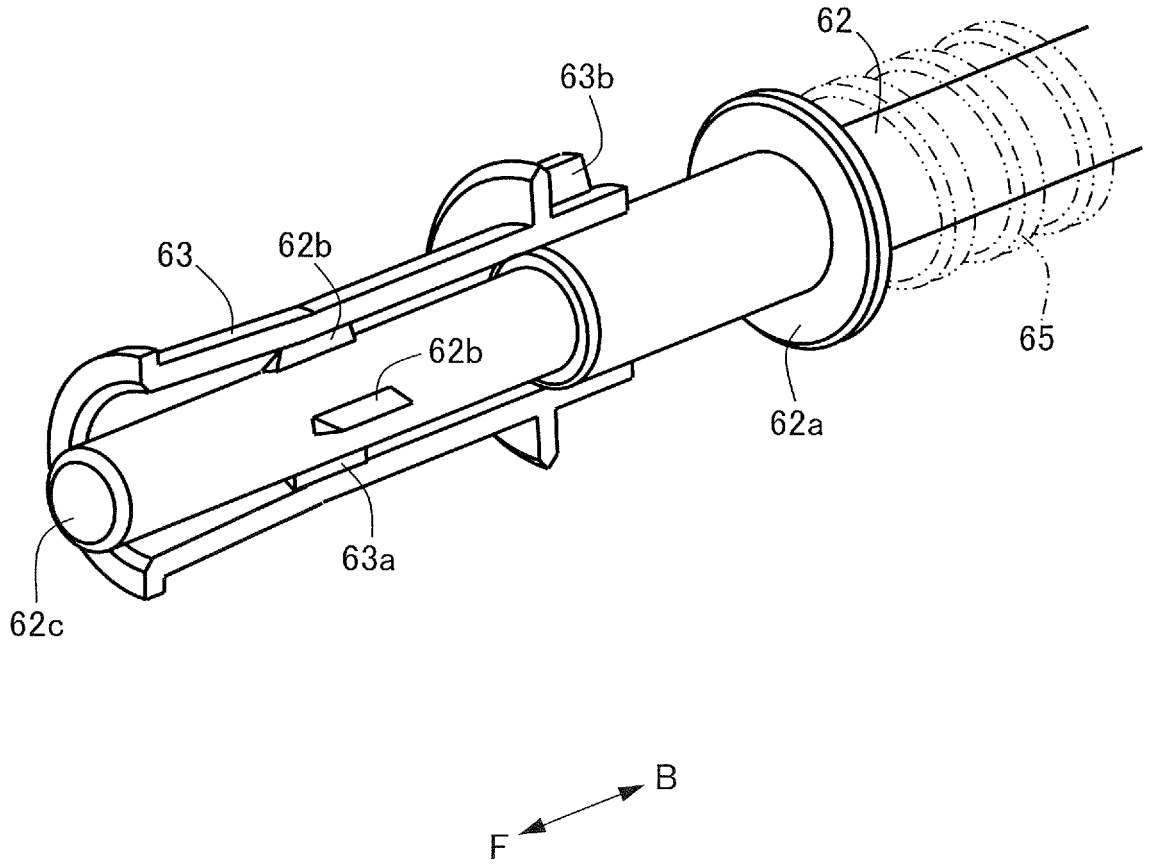
FIG. 11 is a perspective view illustrating a shaft and a latch driving member of the locking unit of the first embodiment.

Next, the locking unit 6 will be described in detail with reference to FIGS. 9 through 11. As illustrated in FIGS. 9 and 10, the locking unit 6 includes the latch 60, the base 61, a shaft 62, a latch driving member 63, a latch spring 64, a shaft spring 65 serving as a shaft urging portion and one-way gear 66 (see FIG. 8A). The shaft 62 serving as the rotation shaft and the cylindrical latch driving member 63 serving as the sleeve slidably provided around the shaft 62 can be rotated by the driving force from the driving motor 52. Still further, the rotation axial direction of the shaft 62 runs along the front-back direction which is an insert direction in which the toner container 42*y* is to be inserted into the mount portion 12*y*. Note that while the base 61 is fixed at an upper part of the inner cover 24 (see FIGS. 4A and 4B), the base 61 is not illustrated in FIG. 10.

The latch 60 serving as a locking member is disposed such that a longitudinal direction thereof is in line with the front-and-back direction and is swingably supported to the base 61 by the swing shaft 67 provided approximately at a center part in the front-and-back direction. That is, the latch 60 includes a swing hole 60*a* swingably supported by the swing shaft 67, an engaged portion 60*b* and a hook 60*c* provided at the back side B and a lock portion 60*d* provided at the front side F. The swing shaft 67 is fixed to the base 61 such that a center line thereof is in line with a lateral direction of the apparatus body 10 (see FIG. 2). That is, the swing shaft 67 is provided between the lock portion 60*d* and the engaged portion 60*b* and makes the latch 60 swingable in a rotation axial direction in a direction orthogonal to the rotation axial direction which is the front-and-back direction. Note that the latch 60 and the swing shaft 67 constitute a locking unit. The latch 60 enables the exchange door 13*y* to be switched between a first position (see FIGS. 8A and 8C) in which the exchange door 13*y* can be locked in the close state and a second position (see FIG. 8B) in which the exchange door 13*y* cannot be locked in the close state.

The latch 60 is swingably held by the base 61, and the latch spring 64 serving as a lock urging portion composed of a tensile coil spring is stretched from the hook 60*c*. That is, the latch spring 64 is provided such that a lower end portion thereof is fixed to the hook 60*c* of the latch 60 and an upper end portion thereof is fixed to the base 61 and urges the back side B of the latch 60 toward an upper side, i.e., toward the first position.

The shaft 62 is rotatably and movably held along the rotation axial direction by the base 61 in a vicinity of an end portion of the front side F. The one-way gear 66 (see FIG. 6) is fixed in a vicinity of an end portion at the back side B of the shaft 62. The shaft spring 65 is composed of a compression coil spring such that an end portion thereof on the front side F axially abuts with the flange portion 62*a* provided fixedly to the shaft 62 and an end portion of the back side B thereof abuts with the base 61 (see FIG. 9). Thereby, the shaft spring 65 urges the shaft 62 to the front side F toward the exchange door 13*y* along the rotation axial direction and the shaft 62 is always urged to the front side F with respect to the base 61.

The latch driving member 63 is sleeve-like, is slidably held around an outer circumference of the shaft 62 and is disposed such that an axial position to the base 61 is fixed. As illustrated in FIG. 11, the latch driving member 63 is approximately a cylindrical shape and is held by the shaft 62 as the shaft 62 passes through an inner part of the cylinder. The shaft 62 is provided with an engagement projection (first projection) 62*b* on the outer circumferential surface thereof. The latch driving member 63 is provided with an engaged projection (second projection) 63*a* capable of engaging with the engaging projection 62*b* in the rotation direction on an inner circumferential surface thereof. The latch driving member 63 is also provided with an engage portion 63*b* on an outer circumferential surface thereof. Note that the engaging projection 62*b* and the engage portion 63*b* are provided at four places each approximately at equal intervals of 90 degrees in a circumferential direction in the present embodiment. However, this arrangement is not limited to be 90 degrees each. The engage portion 63*b* is formed on an outer circumferential part of the latch driving member 63 so as to project in a radial direction. The engage portion 63*b* is capable of switching the latch 60 from the first position to the second position by engaging with the latch 60. Still further, for example, the engaging projections 62*b* may be provided at four places and the engage portion 63*b* may be provided at one place. Or, for example, the engaging projection 62*b* may be provided at one place and the engage portions 63*b* may be provided at four places.

The engaging projection 62*b* and the engaged projection 63*a* have shapes in such a relationship of gears of inner and outer teeth and are arranged such rotational drive of the shaft 62 is synchronously transmitted to the latch driving member 63 by engaging with each other. Note that because the shaft 62 is slidable in the axial direction with respect to the latch driving member 63, the rotational drive can be transmitted only when at least parts of the engaging projection 62*b* and the engaged projection 63*a* overlap in the axial direction like when the exchange door 13*y* is in the close state (see FIG. 8A). In a case where the engaging projection 62*b* and the engaged projection 63*a* do not overlap in the axial direction at all like when the exchange door 13*y* is in the open state (see FIG. 8B), no rotational drive is transmitted. That is, the latch driving member 63 is capable of moving to the first position (see FIG. 8A) where the engaging projection 62*b* and the engaged projection 63*a* engage in the rotation direction and to the second position (see FIG. 8B) where the engaging projection 62*b* and the engaged projection 63*a* do not engage in the rotation direction along the rotation axial direction. Still further, in a case where the exchange door 13*y* is in the close state, the latch driving member 63 is located at the first position (see FIG. 8A) and in a case where the exchange door 13*y* is in the open state, the latch driving member 63*y* is located at the second position (see FIGS. 8B and 8C). The shaft 62 is relatively movable in the rotation axial direction with respect to the latch driving member 63. Then, an engage position where the shaft 62 and the latch driving member 63 rotate in a body by engaging with each other is switched to a disengage position where the shaft 62 and the latch driving member 63 idle without being engaged by the relative move in the rotation axial direction of the shaft 62.

Note that there is a possibility that the engaging projection 62*b* abuts with the engaged projection 63*a* in the axial direction and interferes with movement of the latch driving member 63 when the latch driving member 63 moves from the second position to the first position. Then, according to the present embodiment, at least one of counter faces in the axial direction of the engaging projection 62*b* and the engaged projection 63*a* is tapered such that the engaging projection 62*b* or the engaged projection 63*a* evades in the rotation direction even if they abut with each other.

The locking unit 6 is assembled to the apparatus body 10 such that the base 61 is fixed to the inner cover 24 and such that the end portion of the back side B of the shaft 62 is held by the base 51 rotatably and movably in the axial direction. As illustrated in FIGS. 8A through 8C, the one-way gear 66 always engages with the driving gear 57 regardless of the axial position of the shaft 62. The end portion of the back side B of the shaft 62 is arranged to be displaceable to a position (see FIG. 8A) of blocking a detection area of the opening/closing sensor 58 and a position (see FIG. 8B) of receding from the detection area by the move of the shaft 62 in the axial direction.

As illustrated in FIG. 6, the one-way gear 66 includes a driven gear 66*a* engaging with a driving gear 57 and a one-way clutch 66*b* fixed to the shaft 62. The one-way clutch 66*b* is arranged such that the driven gear 66*a* idles with respect to the shaft 62 in a case where a rotation direction of the driving gear 57 is in the R1 direction and the rotational drive is transmitted from the driven gear 66*a* to the shaft 62 in a case where the rotation direction of the driving gear 57 is in the R2 direction. That is, the one-way clutch 66*b* is interposed between the driven gear 66*a* and the shaft 62. The one-way clutch 66*b* idles in a case where the driving gear 57 rotates in the R1 direction, i.e., in a first rotation direction, and transmits rotation of the driven gear 66*a* to the shaft 62 in a case where the driving gear 57 rotate in the R2 direction, i.e., in a second direction, inverse from the R1 direction, to drive the shaft 62. Note that because toner is supplied from the toner container 42*y* to the developing unit 83*y* when the driving gear 57 is rotated in the R1 direction, the one-way gear 66 is idled in supplying toner from the toner container 42*y* to the developing unit 83*y*. Still further, if the driving gear 57 is rotated in the R2 direction inverse to the rotation direction in supplying toner, the rotational drive is transmitted to the shaft 62 and the close state of the exchange door 13*y* is unlocked.

By the way, as a mechanism for operating the latch 60 in opening/closing the exchange door 13*y*, such an arrangement of unlocking the latch 60 through a cam mechanism is conceivable by utilizing the driving source such as the driving motor 52 for example. That is, it is conceivable to adopt such an arrangement which includes a rotating cam rotated by the driving source and its follower and in which the latch 60 is swung by the follower. However, such arrangement requires high definition detection and control of a rotation angle to control a phase of the rotating cam. Due to that, such arrangement requires a number of expensive components and hampers simplification of the configuration and reduction of the costs. Then, the present embodiment provides the engage position, i.e., the first position, where the driving force can be transmitted from the shaft 62 and the latch driving member 63 to the latch 60 and the disengage position, i.e., the second position, where the transmission of the driving force from the shaft 62 and the latch driving member 63 to the latch 60 is disabled. Then, in order to release the lock of the exchange door 13*y* caused by the latch 60, the shaft 62 and the latch driving member 63 are positioned at the engage position when the exchange door 13*y* is in the close position and the shaft 62 and the latch driving member 63 are positioned at the disengage position when the exchange door 13*y* is in the open state. This arrangement makes it possible to realize a mechanism of releasing the lock with a simple configuration inexpensively when the exchange door 13*y* is locked in the close state. An operation of the present embodiment will be described below.

Next, a series of operations of the locking unit 6 in opening/closing the exchange door 13*y* will be described with reference to FIGS. 8A through 8C. As illustrated in FIG. 8A, because the claw portion 35 provided in the exchange door 13*y* is held by the lock portion 60*d* of the latch 60 in a state in which the exchange door 13*y* is closed, the exchange door 13*y* keeps the closed state without swinging. That is, the latch 60 is capable of locking the exchange door 13*y* in the close state, and the lock portion 60*d* is engageable with the exchange door 13*y* and locks the exchange door 13*y* in the close state by the engagement. If the position of the latch 60 at this time is set as an original position, the latch 60 is kept at the original position because the latch 60 is urged in a direction of locking the exchange door 13*y* by the latch spring 64, unless an external force is applied.

The shaft 62 is urged in the front side F of the apparatus body 10 by the shaft spring 65 and the axial position of the shaft 62 is defined by an edge 62*c* of the shaft 62 that abuts with the exchange door 13*y* in the closed state. That is, the shaft spring 65 urges the shaft 62 toward the exchange door 13*y* along the rotation axial direction. At this time, the end portion of the back side B of the shaft 62 is located at the position of blocking the detection area of the opening/closing sensor 58 and the control portion 70 judges that the exchange door 13*y* is in the closed state. Still further, as illustrated in FIG. 11, the latch driving member 63 is located at the first position in the axial direction where the engaging projection 62*b* of the shaft 62 engages with the engaged projection 63*a* of the latch driving member 63 in the rotation direction. Due to that, the shaft 62 and the latch driving member 63 are in the positional relationship of capable of transmitting the driving force synchronously in the rotation direction.

Figure 8B:
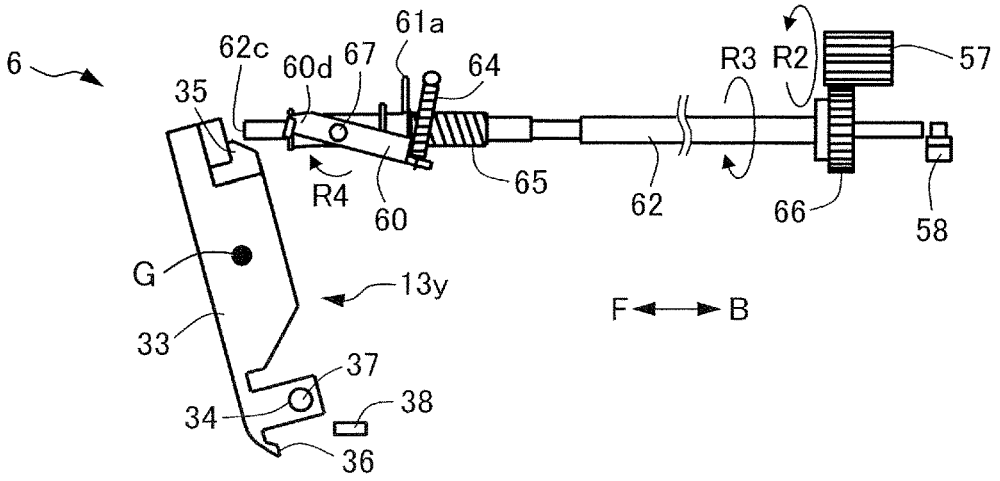
FIG. 8B is a side view illustrating the locking unit of the first embodiment in a state in which the exchange door is slightly opened.

As illustrated in FIG. 8B, the driving motor 52 (see FIG. 6) is driven to rotate the driving gear 57 in the R2 direction to open the exchange door 13*y*. The rotational drive is transmitted from the one-way gear 66 to the shaft 62 by the rotation of the driving gear 57, so that the shaft 62 rotates in a R3 direction. Because the shaft 62 and the latch driving member 63 are in the positional relationship of transmitting the rotational drive (see FIG. 10) at this time, the latch driving member 63 also rotates in the R3 direction. The engage portion 63*b* presses down the engaged portion 60*b* of the latch 60 by the rotation of the latch driving member 63, so that the latch 60 swings in a R4 direction and the engagement between the claw portion 35 of the exchange door 13*y* and the lock portion 60*d* of the latch 60 is released. That is, the engage portion 63*b* and the engaged portion 60*b* engage with each other by the rotation of the shaft 62 and the latch driving member 63. Thereby, the engage portion 63*b* and the engaged portion 60*b* switch the latch 60 from the lock state (see FIG. 8A) in which the latch 60 locks the exchange door 13*y* in the close state to the unlock state (see FIGS. 8B and 8C) in which the latch 60 releases the lock in the close state. Thereby, the exchange door 13*y* starts to swing in a direction of opening by own weight of the exchange door 13*y*.

The shaft 62 moves along the rotation axial direction toward the front side F by the shaft spring 65 because no restriction of thrust position at the edge 62*c* is made by the exchange door 13*y*. That is, in a case where the engage portion 63*b* switches the latch 60 to the unlock state, the shaft spring 65 presses such that the exchange door 13*y* is switched to the open state by the shaft 62. Note that a force of moving the shaft 62 in the axial direction by the shaft spring 65 plays an auxiliary function of swinging the exchange door 13*y*. That is, while the exchange door 13*y* swings by its own weight, there is a possibility that the exchange door 13*y* becomes hard to swing by its own weight when a movable part is caught by a foreign substance for example. The force of moving the shaft 62 in the axial direction by the shaft spring 65 becomes a force of pushing the exchange door 13*y* in the direction of opening the exchange door 13*y* even in such a case, so that the exchange door 13*y* can be opened reliably. Still further, the end portion of the back side B of the shaft 62 is in a positional relationship of separating from the detection area of the opening/closing sensor 58 and thereby, the control portion 70 judges that the exchange door 13*y* is opened.

Figure 8C:
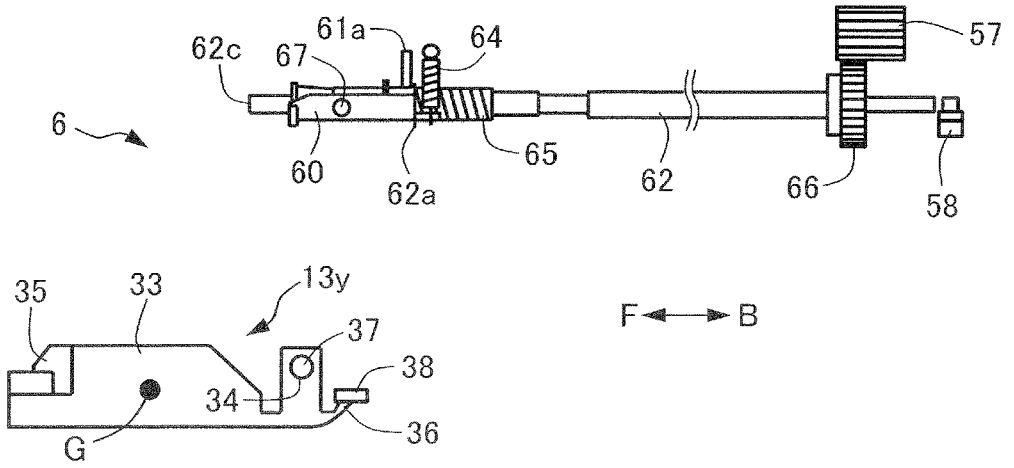
FIG. 8C is a side view illustrating the locking unit of the first embodiment in a state in which the exchange door is completely opened.

Still further, when the exchange door 13*y* is completely opened as illustrated in FIG. 8C, the shaft 62 which has released from the positional restriction of the exchange door 13*y* moves in the axial direction until when a flange portion 62*a* of the shaft 62 abuts with a base 61*a* provided on the base 61. Thereby, the position of the shaft 62 is defined in the state in which the exchange door 13*y* is opened. At this time, the latch driving member 63 is located at the second position in the axial direction, and the engaging projection 62*b* provided on the shaft 62 and the engaged projection 63*a* provided on the latch driving member 63 are in a positional relationship of transmitting no rotational drive because they are shifted in the axial direction. Therefore, because the latch driving member 63 becomes rotatable without receiving the driving force from the shaft 62 and the force of the engage portion 63*b* of the latch driving member 63 of pressing down the engaged portion 60*b* of the latch 60 is released, the latch 60 returns to the original position by the latch spring 64. Along with the return of the latch 60 to the original position, the engaged portion 60*b* of the latch 60 presses up the engage portion 63*b* of the latch driving member 63. The end portion of the back side B of the shaft 62 is also in the positional relationship of separating from the detection area of the opening/closing sensor 58, so that the control portion 70 judges that the exchange door 13*y* is opened. Thus, the exchange door 13*y* of the mount portion 12*y* in which the toner container 42*y* to be exchanged is mounted is automatically opened, the user can discriminate the object to be exchanged without erroneously recognizing with other objects.

That is, in a case where the exchange door 13*y* is in the close state, the shaft 62 is located at the engage position and the engage portion 63*b* switches the latch 60 from the first position to the second position by driving the driving motor 52 to make the exchange door 13*y* unlockable in the close state. Still further, in a case where the exchange door 13*y* is in the open state, the shaft 62 is located at the disengage position and the latch spring 64 switches the latch 60 from the second position to the first position to make the exchange door 13*y* lockable in the close state.

In returning the exchange door 13*y* being opened to the closed state again, the user manually closes the opened exchange door 13*y*. At this time, the edge 62*c* of the shaft 62 is pushed toward the back side B by the exchange door 13*y*, the claw portion 35 pushes up the lock portion 60*d* of the latch 60 and is locked to return to the state illustrated in FIG. 8A. The end portion at the back side B of the shaft 62 moves to the position of blocking the detection area of the opening/closing sensor 58, so that the control portion 70 judges that the exchange door 13*y* is closed. Here, because the shaft 62 and the latch driving member 63 are separate members and relatively movable in the axial direction from each other in the present embodiment, the latch driving member 63 barely moves in the axial direction. Due to that, the relative position in the axial direction of the engaged portion 60*b* of the latch 60 and the engage portion 63*b* of the latch driving member 63 barely changes regardless of the axial position of the shaft 62 and the opening/closing state of the exchange door 13*y*. Therefore, it is possible to prevent the engaged portion 60*b* of the latch 60 and the engage portion 63*b* of the latch driving member 63 from becoming an obstacle of the swing of the exchange door 13*y* in advance otherwise caused by their abutment in the axial direction in switching the exchange door 13*y* from the open state to the close state.

Figure 12:
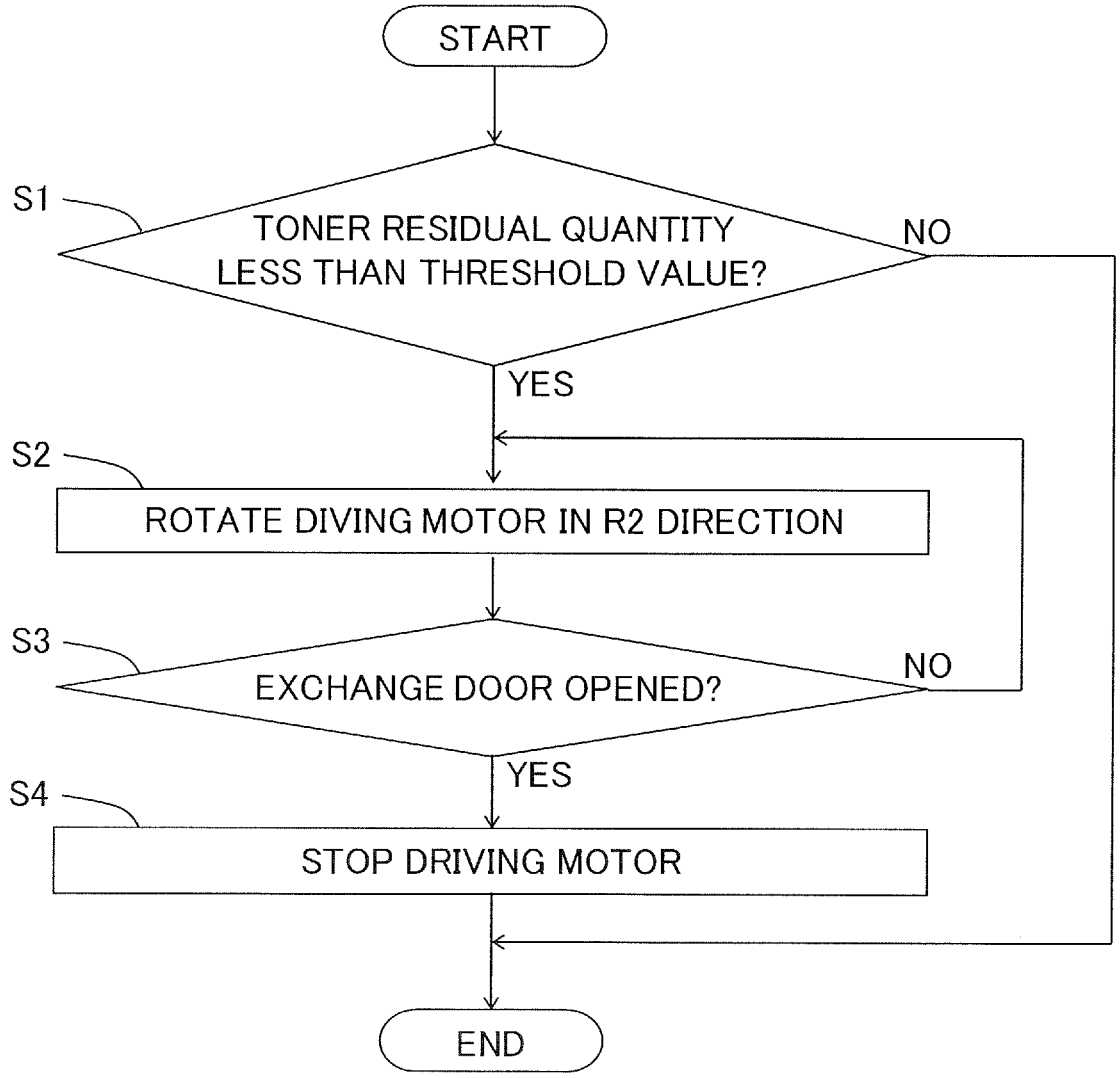
FIG. 12 is a flowchart illustrating a processing procedure in opening the exchange door to exchange the toner container in the image forming apparatus of the first embodiment.

Next, a procedure in exchanging the toner container 42*y* in the image forming apparatus 1 described above will be described along a flowchart as illustrated in FIG. 12. The control portion 70 confirms a toner residual quantity of the toner container 42*y* by a toner container residual quantity detecting unit to judge whether the toner residual quantity is equal to or less than a threshold value in Step S1. For the toner container residual quantity detecting unit, an appropriate method may be applied to confirm the toner residual quantity of the toner container 42*y* such as a method of estimating the toner residual quantity from a replenished quantity per one replenishment and a number of times of the replenishments, a method of estimating the toner residual quantity from toner concentration within the developing unit 83*y* and a method of measuring weight of the toner container 42*y*. In a case where the control portion 70 judges that the toner residual quantity is not less than the threshold value after confirming the toner residual quantity of the toner container 42*y*, i.e., No in Step S1, the control portion 70 finishes the process because the toner container 42*y* needs not be exchanged.

In a case where the control portion 70 judges that the toner residual quantity is less than the threshold value after confirming the toner residual quantity of the toner container 42*y*, i.e., Yes in Step S1, the control portion 70 judges that that toner container 42*y* is an object to be exchanged. Then, the control portion 70 rotates the driving motor 52 (see FIG. 4A) in a station of the toner container 42*y* in the R2 direction inverse to the rotation direction in supplying toner in Step S2 (see FIG. 8A).

Then, the control portion 70 judges whether the exchange door 13*y* is in the open state in Step S3. The control portion 70 judges that the exchange door 13*y* is in the open state in a case where the control portion 70 judges that the end portion on the back side B of the shaft 62 has got out of the detection area of the opening/closing sensor 58 based on a signal from the opening/closing sensor 58. In a case where the control portion 70 judges that the exchange door 13*y* is not in the open state, i.e., No in Step S3, the exchange door 13*y* is kept in the close state, so that the driving motor 52 is continuously driven in Step S2.

In a case where the control portion 70 judges that the exchange door 13*y* is in the open state, i.e., Yes in Step S3, the control portion 70 stops to drive the driving motor 52 because the exchange door 13*y* is in the open state in Step S4 (see FIG. 8C). After opening the exchange door 13*y*, the user draws out the toner container 42*y* whose toner residual quantity has become less than the threshold value, mounts a new toner container 42*y* to the mount portion 12*y* and closes the exchange door 13*y*. When the control portion 70 rotates the driving motor 52 in the R1 direction, no driving force is transmitted to the shaft 62 and the exchange door 13*y* is kept in the close state. Then, the toner container 42*y* rotates to supply toner to the developing unit 83.

As described above, according to the developer container storage apparatus 3 of the present embodiment, the engage portion 63*b* and the engaged portion 60*b* switch the latch 60 from the lock state in which the exchange door 13*y* is locked in the close state to the unlock state in which the lock is released in switching the exchange door 13*y* from the closed state to the open state. Due to that, in a case where the exchange door 13*y* is locked in the close state, it is possible to deal with such case by realizing the lock releasing mechanism as described above with the simple configuration inexpensively as compared to a case of detecting and controlling a phase by using a cam mechanism. Still further, it is possible to realize the lock releasing mechanism with the simple configuration inexpensively as compared to a case of having a dedicated actuator serving as a driving unit for releasing the lock in the close state per each of the exchange doors 13*y*, 13*m*, 13*c* and 13*k*.

Still further, according to the developer container storage apparatus 3 of the present embodiment, because the shaft 62 and the latch driving member 63 are separate members and are relatively movable with each other in the axial direction, the relative position in the axial direction of the engaged portion 60*b* of the latch 60 and the engage portion 63*b* of the latch driving member 63 barely changes. Therefore, when the exchange door 13*y* is manually closed, the engaged portion 60*b* of the latch 60 does not abut with the engage portion 63*b* of the latch driving member 63 in the axial direction and the exchange door 13*y* can be closed smoothly.

Still further, according to the developer container storage apparatus 3 of the present embodiment, the developer container storage apparatus 3 enables to control the opening operation of the exchange door 13*y* by using the same driving source for driving the toner container 42*y*. This arrangement makes it possible to realize the lock releasing mechanism with the simple construction inexpensively because the dedicated actuator for the opening operation of the exchange door 13*y* is not required.

Note that the follow problem occurs in a case where only the latch 60 is swung by transmitting the driving force from the driving source of the toner container 42*y* to the latch 60, i.e., in a case of a configuration in which the transmission of the driving force is not switched by the open/close state of the exchange door 13*y*. In this case, there is a possibility that a state in which an external force is continuously applied to the latch 60 occurs and the latch 60 is fixed in the swing position (see FIG. 8B). It is unable to return the exchange door 13*y* to the closed state in this state. As a method for avoiding this problem, it is necessary to detect a swing amount and a swing position of a drive transmission mechanism for swinging the latch 60 to control a swing state of the latch 60, thus complicating configurations and controls of such mechanism. In contrary to that, according to the developer container storage apparatus 3 of the present embodiment, the link of the drive is automatically shut off by the transition of the open/close state of the exchange door 13*y*, and the latch 60 returns to the original position by the latch spring 64. This arrangement makes it unnecessary to provide sensors for controlling and detecting the swing amount of the latch 60, thus realizing the simple configuration inexpensively.

Second Embodiment

Next, a second embodiment of the present disclosure will be described in detail with reference to FIGS. 13 and 14. The present embodiment is different from the configuration of the first embodiment in that a shaft 162 serving as the rotation shaft and a latch driving member 163 are fixed relatively in an axial direction. However, configurations other than that are the same with the first embodiment, so that they are denoted by the same reference signs and their detailed description will be omitted here.

Figure 13:
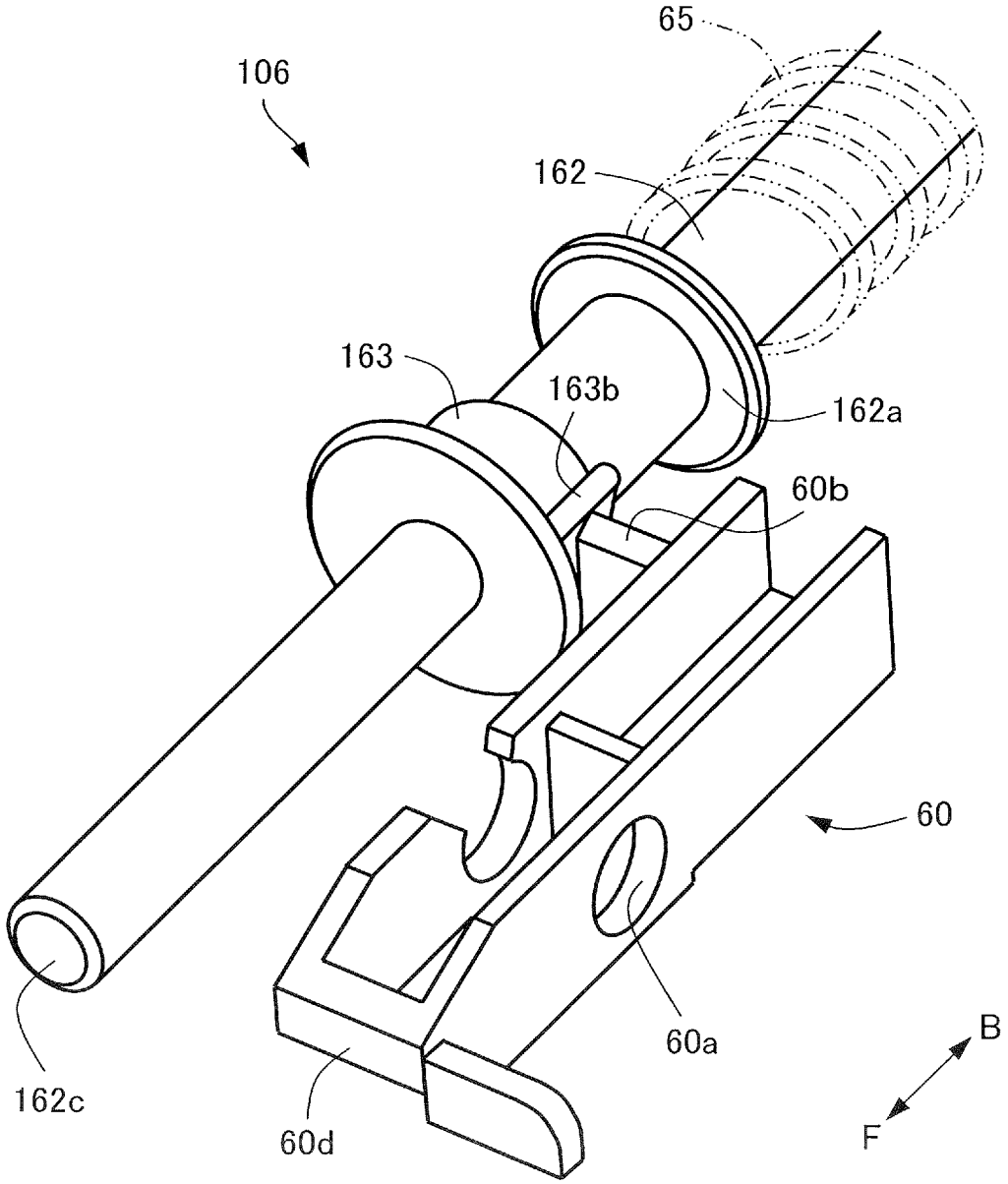
FIG. 13 is a perspective view illustrating a shaft, a latch driving member and a latch of a locking unit of a second embodiment.
Figure 14:
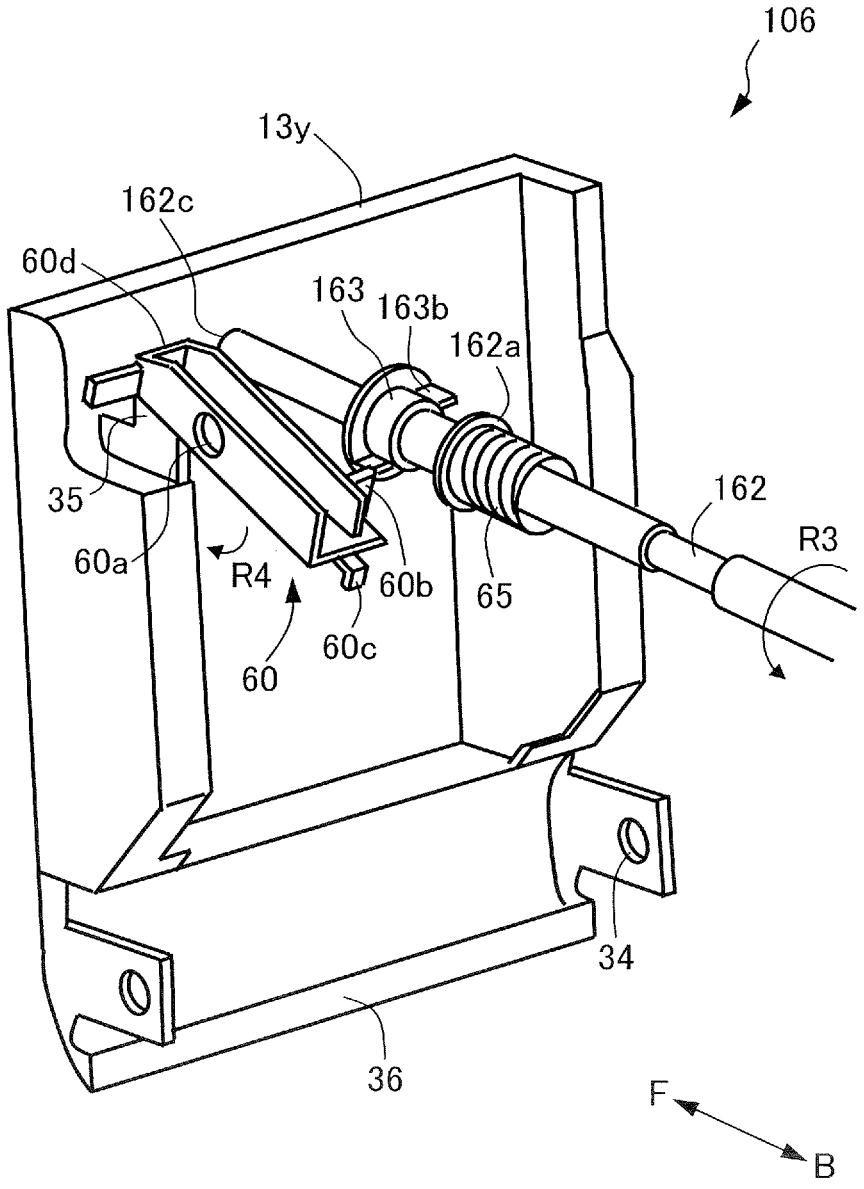
FIG. 14 is a perspective view illustrating a locking unit and an exchange door of the second embodiment.

As illustrated in FIG. 13, a locking unit 106 includes a latch 60, a base 61 (see FIG. 9), a shaft 162, a latch spring 64 (see FIG. 9), a shaft spring 65 and a one-way gear 66 (see FIG. 8A). A relationship among the shaft 162, the base 61, the shaft spring 65 and the one-way gear 66 in the locking unit 106 is the same with that of the first embodiment. That is, the shaft 162 is held by the base 61 rotatably and movable along the rotation axial direction in a vicinity of the end portion of the front side F and is provided such that a force of urging to the front side F acts from the shaft spring 65 through the flange portion 162*a*. Still further, the one-way gear 66 is provided in the vicinity of the end portion of the back side B of the shaft 162. The drive is transmitted to the shaft 162 through the one-way gear 66 only when the driving motor 52 is rotationally driven in the R2 direction (see FIG. 6) inverse to the R1 direction (see FIG. 6) in supplying toner by the one-way gear 66.

In the present embodiment, the latch driving member 163 is integrated with the shaft 162. Here, the shaft 162 and the latch driving member 163 are integrally formed. The latch driving member 163 is provided with an engage portion 163*b* and to that end, the shaft 162 and the engage portion 163*b* are fixed in the axial and rotation directions. The engage portion 163*b* is formed integrally so as to project in the radial direction on an outer circumferential portion of the shaft 162. The engage portion 163*b* is engageable with the engaged portion 60*b* provided on the latch 60 and is capable of rotating the latch 60 by the rotation of the shaft 162. Still further, the shaft 162 is provided slidably in the axial direction with respect to the base 61, and the axial position of the engage portion 163*b* is uniquely determined by the axial position of the shaft 162. The engage portion 163*b* is arranged to be switchable to an engage position where it is engageable with the engaged portion 60*b* of the latch 60 by its rotation and to a disengage position where it is disengageable with the engaged portion 60*b* even if it rotates depending on the axial position of the latch 60 with respect to the engaged portion 60*b*. That is, the engage portion 163*b* is movable to the engage position where it is engageable with the latch 60 and to the disengage position where it idles without engaging with the latch 60 by the move in the axial direction of the shaft 162. Thus, a drive transmission path from the shaft 162 to the latch 60 in the locking unit 106 is linked or shut off depending on the axial position of the shaft 162. Note that the shaft 162 and the latch driving member 163 are rotatable by the driving force from the driving motor 52 in the same manner with the first embodiment.

Next, a series of operations of opening the exchange door 13*y* by the locking unit 106 of the present embodiment will be described with reference to FIG. 14. In a state in which the exchange door 13*y* is closed, an axial position of the shaft 162 is defined by a position where an edge 162*c* of the shaft 162 abuts with the exchange door 13*y* (see FIG. 8A). At this time, an axial positional relationship between the engage portion 163*b* and the engaged portion 60*b* is what in which they are engageable as the shaft 162 rotates. As illustrated in FIG. 14, the drive is transmitted and the shaft 162 rotates in the R3 direction when a rotational drive is made by the driving motor 52 (see FIG. 6) in the R2 direction inverse to the direction in which toner is supplied. Because the engage portion 163*b* and the engaged portion 60*b* are in the positional relationship of engageable with each other at this time, the engage portion 163*b* abuts with the engaged portion 60*b* in the rotation direction to press down the engaged portion 60*b* to swing the latch 60. When the engagement of the latch 60 with the claw portion 35 of the exchange door 13*y* is released as the latch 60 swings, the exchange door 13*y* starts to swing.

When the lock of the exchange door 13*y* is released after that, no restriction on the axial position of the shaft 162 is provided, so that the shaft 162 is moved to the front side F in the axial direction by the shaft spring 65. Due to the move of the shaft 162 toward the front side F, the engage portion 163*b* is put into a positional relationship of disengageable with the engaged portion 60*b* even it rotates and no external force for swinging the latch 60 acts, the latch 60 is returned to the original position by the latch spring 64.

That is, in a case where the exchange door 13*y* is in the close state, the engage portion 163*b* is located at the engage position. Then, as the driving motor 52 drives, the engage portion 163*b* switches the latch 60 from the first position to the second position and makes the exchange door 13*y* unlockable in the close state. Still further, in a case where the exchange door 13*y* is in the open state, the engage portion 163*b* is located at the disengage position, and the latch spring 64 switches the latch 60 from the second position to the first position to make the exchange door 13*y* lockable in the close state.

In a case that the exchange door 13*y* is switched from the close state to the open state, the engage portion 163*b* and the engaged portion 60*b* switch the latch 60 to the unlock state in which the exchange door 13*y* locked in the close state is released from the lock state in which the exchange door 13*y* is locked in the close state also in the developer container storage apparatus 3 described above. Due to that, in the case of locking the exchange door 13*y* in the close state, it is possible to realize the lock releasing mechanism with the simple configuration inexpensively as compare to the case of detecting and controlling a phase by using a cam mechanism. Still further, it is possible to realize the lock releasing mechanism with the simple configuration inexpensively as compared to a case of having a dedicated actuator serving as a driving unit for releasing the lock in the close state per each of the exchange doors 13*y*, 13*m*, 13*c* and 13*k*.

Still further, according to the developer container storage apparatus 3 of the present embodiment, because the shaft 162 and the latch driving member 163 are integrated, it is possible to reduce a number of component parts as compared to a case where they are separate members and to realize them with a simpler configuration inexpensively.

According to the present embodiment, in a case where the exchange door of the storage portion configured to store the developer container is locked in the close state, it is possible to realize the lock releasing mechanism with the simpler configuration inexpensively.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-058811, filed Mar. 26, 2019 which is hereby incorporated by reference herein in its entirety.

What is claimed is:

1. An image forming apparatus comprising:

an image bearing member on which an electrostatic image is formed;

a developing unit configured to develop the electrostatic image formed on the image bearing member by using developer including toner;

a driving unit;

a driving gear configured to drive rotationally in a first rotational direction or a second rotational direction inverse from the first rotational direction by changing a driving direction of the driving unit;

a toner replenishing container configured to attach to an attaching portion of the image forming apparatus and to accommodate the toner to replenish to the developing unit, the toner replenishing container comprising an input gear input a driving force and being rotationally driven in a case where the driving force is input to the input gear;

a door configured to open and close the attaching portion;

a first mechanism comprising a rotatable shaft input a driving force, the first mechanism being configured to change an open/close state of the door so that the open/close state is changed from a state that the door closes the attaching portion to a state that the door opens the attaching portion in accordance with the shaft being rotationally driven in a predetermined direction by inputting the driving force to the shaft; and a second mechanism configured to change an input state of the driving force to the shaft so that the driving force transmitted through the driving gear is not input to the shaft in a case where the driving gear is rotationally driving in the first rotational direction in a state that the toner replenishing container is attached to the attaching portion, and the driving force transmitted through the driving gear is input to the shaft in a case where the driving gear is rotationally driving in the second rotational direction in the state that the toner replenishing container is attached to the attaching portion, wherein in the case where the driving gear is rotationally driven in the first rotational direction in the state that the toner replenishing container is attached to the attaching portion, the toner replenishing container is rotationally driven in a third rotational direction by inputting the driving force transmitted through the driving gear to the input gear so that the toner accommodated in the toner replenishing container is discharged from the toner replenishing container, and wherein in the case where the driving gear is rotationally driven in the second rotational direction in the state that the toner replenishing container is attached to the attaching portion, the toner replenishing container is rotationally driven in a fourth rotational direction inverse from the third rotational direction by inputting the driving force transmitted through the driving gear to the input gear.

2. The image forming apparatus according to claim 1, further comprising:

a toner quantity detecting portion configured to detect a quantity of the toner accommodated in the toner replenishing container; and a control portion configured to control the driving unit so that the driving gear is rotationally driven in the second rotational direction in a case where the quantity of the toner accommodated in the toner replenishing container detected by the toner quantity detecting portion is equal to or less than a predetermined quantity.

3. The image forming apparatus according to claim 2, further comprising:

an opening/closing detecting portion configured to detect the state that the door opens the attaching portion, wherein the control portion is configured to control the driving unit so that the driving gear is rotationally driven in the second direction until the state that the door opens the attaching portion is detected by the opening/closing detecting portion in a case where the quantity of the toner accommodated in the toner replenishing container detected by the toner quantity detecting portion is equal to or less than a predetermined quantity.

* * * * *